US005494409A

United States Patent [19]

Webb et al.

[11] Patent Number: 5,494,409

[45] Date of Patent: Feb. 27, 1996

[54] GAS PUMP VAPOR RECOVERY SYSTEM

[76] Inventors: Michael C. Webb, 422 S. Saddlebrook Cir., Chester Springs, Pa. 19425; Thomas Wilson, 50 Cascade Springs Pl., The Woodlands, Tex. 77381; Ken Kunaniec, 5023 Santa Rita Rd., Richmond, Calif. 94803

[21] Appl. No.: 130,370

[22] Filed: Oct. 1, 1993

[51] Int. Cl.[6] ..... F04B 53/20; B65B 1/16

[52] U.S. Cl. ..... 417/53; 417/313; 141/285; 141/290

[58] Field of Search ..... 417/313, 53; 141/285, 141/286, 290

[56] References Cited

U.S. PATENT DOCUMENTS

| | | | |
|---|---|---|---|
| 3,996,976 | 12/1976 | Hansel | 141/285 |
| 4,098,308 | 7/1978 | Purdum | 141/285 |
| 4,223,706 | 9/1980 | McGahey | 141/59 |
| 4,260,000 | 4/1981 | McGahey | 141/290 |
| 4,306,594 | 12/1981 | Plawck | 141/290 |
| 4,699,638 | 10/1987 | Harris | 55/168 |
| 4,770,677 | 9/1988 | Harris | 55/168 |
| 4,816,045 | 3/1989 | Szlaga et al. | 55/168 |
| 5,038,838 | 8/1991 | Bergamini et al. | 141/290 |
| 5,123,817 | 6/1992 | Willemsen | 141/290 |

FOREIGN PATENT DOCUMENTS

| | | | |
|---|---|---|---|
| 0534487 | 3/1993 | European Pat. Off. | 141/285 |
| 0588393 | 3/1994 | European Pat. Off. | 141/285 |
| 4202873 | 8/1993 | Germany | 141/285 |
| 4214424 | 10/1993 | Germany | 141/290 |

*Primary Examiner*—Richard A. Bertsch
*Assistant Examiner*—Peter G. Korytnyk
*Attorney, Agent, or Firm*—Eugene E. Renz, Jr.

[57] ABSTRACT

A vapor recovery system for use with fuel dispensing nozzles. The system includes a fuel dispensing nozzle and a vapor piping line operably connected to the nozzle for insertion into a tank for receiving fuel. The line has a small diameter with respect to the diameter of the fuel dispensing hose supplying fuel to the nozzle. A sump is connected to the other end of the line and has a source of vacuum for positively assisting flow of vapor through the line. The sump includes a filter for separating fuel from the vapor to produce vapor clean air. It also has both a vent for venting the vapor clean air and a drain for removing the separated fuel. The system preferably further includes a vacuum regulator means for regulating the vacuum in the vapor piping line by controlling the vacuum at about 1 to about 5 inches of mercury in the line.

20 Claims, 4 Drawing Sheets

GAS PUMP VAPOR RECOVERY SYSTEM

FIELD OF THE INVENTION

The present invention relates to a vapor recovery system for use with fuel dispensing nozzles. More particularly, the present invention relates to a system for dispensing fuel from storage tanks, such as underground storage tanks, to a vehicle fuel tank in which all or substantially all of the vapors escaping from the vehicle tank are recovered and transferred back to the storage tank from which the liquid fuel has been withdrawn.

BACKGROUND OF THE INVENTION

In recent years the concern for protecting our environment has grown considerably. The United States, as a country, has become very interested in protecting wildlife, forests, both above and below ground water resources and in improving our air quality.

There are many sources of air pollution which contribute to the overall pollution problem Factory emissions, automobile and truck emissions and fluorocarbons emissions are the most common type of air pollutants. Aromatic emissions from liquid hydrocarbon fuels are another type of air pollutant. A typical source of aromatic pollution originates from the transfer of these liquid fuels from one storage tank to another. Filling an empty storage tank with fuel causes the air inside to be displaced by the liquid pouring in. When this occurs, the air mixes with the fuel and becomes vaporous, being forced out of the tank. This fuel laden vapor mixes with the atmosphere and forms part of the soup called air pollution.

A typical instance of fuel transfer can be found at a truck or automobile service station. There are two types of fuel transfer which occur at service stations, both of which have recently come under regulation. The first type of fuel transfer is from a delivery tanker truck directly into a below or above ground bulk fuel storage tank. This bulk transfer fuel is now regulated under what is called "Stage I Vapor Recovery" which requires an approved means of recovering all of the vapors escaping from the storage tank and transferring them into the bulk fuel delivery truck or tanker truck that is pumping the liquid fuel. This type of system requires that a vapor hose interconnect the tanker truck and the storage tank.

The second type of fuel transfer is from the storage tank to the vehicle tank located on a truck or automobile. This transfer typically requires the use of an underground piping system interconnecting the storage tank and one or more above ground fuel dispensers that meter the amount of liquid fuel transferred. The fuel may be pumped from the storage tank to the dispenser by means of a submersible pump or fuel pump located at the tank. Alternatively, fuel may be suctioned from the storage tank to the dispenser by means of a suction pump located within the dispenser. This transfer fuel is now regulated under what is called "Stage II Vapor Recovery," which requires an approved means of recovering all of the vapors escaping from the vehicle tank and transferring them into the storage tank from which the liquid fuel is being pumped or suctioned by the fuel pump.

The invention relates to the second type of vapor recovery system called Stage II Vapor Recovery. There are a number of approved Stage II Vapor Recovery systems on the market and in use which attempt to recover the fuel vapors which escape the vehicle tank during refueling. All of these systems require a dedicated piping line from the dispenser back to the bulk storage tank. Another requirement is to have a special filling nozzle which provides a vacuum inlet with an attached dedicated return vapor hose for interconnecting the nozzle to the vapor piping located just under the dispenser.

The types of Stage II Vapor Recovery Systems which are approved and available can be classified into two distinct groups. The first group, which most commonly used, are "balanced systems" which use the vacuum created by the displacement of fuel in the storage tank, during pumping, as a means of recovering the vapors being forced out of the vehicle tank and back to the storage tank. The second group are "power assisted systems" which create a vacuum by means of a powered vacuum pump as a means of recovering the vapors being forced out of the vehicle tank during filling. Because power assisted systems are not inherently balanced systems, there exists a concern that the vacuum pumps will not create sufficient vacuum to recover all of the vehicle tank vapors or, alternatively, will cause too much vacuum causing the storage tank to have a positive pressure. This positive pressure will result in the tank venting vapors into the atmosphere through the storage tank's vent lines. To prevent this from occurring power assisted systems have additional mechanical controls and devices to prevent aromatic vapor discharge into the atmosphere through the vent stack.

The balanced system, which is the most commonly used system on the market, is difficult to install properly and does not recover 100% of the vehicle tank's vapor emission back to the storage tank. This system requires that a rigid type vapor piping system be installed which maintains slope (⅛" fall per lineal foot minimum) from each dispenser back to a storage tank typically installed underground. The sloped vapor piping line allows condensed fuel to drain to the storage tank. Flexible pipe would inevitably trap liquids at low points in the path.

Sometimes, particularly in warm weather where the vehicle tank may be at 85° to 95° F., aromatic vapors which are vacuumed out of the vehicle tank may partially condense when they are exposed to the cooler underground vapor piping at 55° F. ground temperature. It is for this reason an adequate slope must be maintained by the rigid vapor piping line so that unrestricted flow will occur all the way to the storage tank. Typically, a 2" or 3" line is installed to provide adequate sizing to compensate or dips and rises in the rigid vapor piping line due to ground settling or improper installation. In some cases where there is not sufficient fall available from the dispenser back to the storage tank, a drop-off tank is installed in the vapor piping line to trap and collect liquid fuel and to create additional fall.

It should be noted that larger diameter vapor piping lines use a slower velocity of air flow. This slower air flow combined with more piping surface area creates a large volume of liquid fuel which can collected through condensation. This is not a problem as long as proper slope is maintained but in practice does cause difficulty in service.

The balanced system uses a combination of a positive and negative atmospheric pressure, as well as gravity, to transfer the vapors from the vehicle tank to the underground storage tank. As previously discussed, the "negative pressure" or vacuum is created by the displacement of fuel leaving the storage tank and the "positive pressure" is created by the fuel being pumped into the vehicle tank. In order to insure that virtually all (99.5% is the present requirement) of the aromatic vapors escaping the vehicle tank are suctioned into the vacuum openings in the nozzle it is necessary to have a rubber boot on the outside of the nozzle to seal the opening in the vehicle tank from the outside atmosphere. This rubber boot creates a direct sealed connection between the nozzle and the opening of the vehicle tank. This seal connection prevents any positive pressure from escaping into the atmosphere from the vehicle tank and prevent outside air from being sucked in by the nozzle.

The problem with the nozzle fitted with a rubber boot is that it is very cumbersome for the customer who is filling the vehicle tank. Additionally, "topping-off the tank" (adding more fuel after the nozzle automatically trips) is not permitted or recommended, creating a lot of loose change for cash customers. Another problem is that worn rubber boots may loose their effectiveness in making a good vacuum seal to ultimately make the balance system less effective.

Another problem with balanced systems is that they require sufficient slope of the vapor piping line from all dispensers to a low point just above the lop of the underground storage tanks. This means that the top of the underground storage tank must be at least 36 inches from the ground surface and in many cases much deeper. This deeper tank burial requirements more costly excavations and additional backfill materials such as pea gravel which can be very expensive. For existing service station sites which are being retro-fitted with Stage II Vapor Recovery Systems this could require that the tanks be removed and buried deeper to maintain proper fall or that in-line drop-off tanks be installed that require constant emptying and maintenance.

Balanced Stage II Vapor Recovery Systems are also very time consuming to install because they require the use of steel or fiberglass rigid piping for the vapor piping lines. In many areas regulators require that the vapor piping be secondarily contained which will more than triple the cost of the vapor piping. Many service stations today are using environmentally safe flexible double wall fuel piping systems. These flexible piping systems are available in long rolls providing continuous piping runs, unlike rigid piping systems which require many piping joints for straight piping connections and directional fittings. One other disadvantage of rigid vapor piping lines is that it can not be routed exactly adjacent to the flexible piping lines because the directional fittings are typically very sharp (90° and 45° turns) and the rigid pipe will obviously not bend to the same extent that flexible piping will.

One type of "Power Assisted Stage II Vapor Recovery System" called the Heally System operates as fellows. The Heally System consists of a nozzle which provides for return hydrocarbon vapor from the vehicle tank through a rubber boot, back to the storage tank. The vapor is subjected to a vacuum source in the nozzle which is created by a liquid gasoline driven jet pump. When the pump switch is activated, gasoline under pressure is provided to the jet pump. A small stream of gasoline diverted from a point ahead of the meter, flows through the jet point and back to the underground storage tank. Vacuum is immediately produced at a controlled maximum level of–24 to –30 inches of water column. When the nozzle is in use, the vapors are recovered through the jet pump and returned to the gasoline storage tank.

One of the difficulties of these type of pumps is that the return of vapor and gasoline to the storage tank will build up pressure in the storage tank, thereby blowing vapor out of the vent stack at the station. While the system may operate normally for a one pump system, typically, the average service station has anywhere from one to twelve or more nozzles operating at the same time. It is extremely difficult to regulate the vacuum over the range required to give the appropriate vacuum without putting excessive pressure on the venting means. The undesirable alternative is to burn off excess vented vapors which is both wastefull and potentially hazardous.

The Hasstech Stage II Vapor Recovery System, manufactured by Hasstech, Inc. of San Diego, provides a vacuum assist created by a central vacuum pump connected to all dispensers. Holes near the tip of the nozzle create a zone of flow pressure in the fill neck which collect the displaced gasoline vapors and prevent them from escaping into the atmosphere. This and other systems using a vacuum assisted vapor recovery system have to date only been able to recover 95% of secondary vapors in the vehicles fuel tanks. All such systems also require that excess vapors be processed for combustion in an on site processing unit.

None of the prior art systems effectively provide a system for dispensing fuel from storage tanks to vehicle fuel tanks without at least some of the vapors escaping from the vehicle tank. Accordingly, it is an object of this invention to provide a system that recovers substantially all of the vapors escaping from a vehicle tank and transfers those vapors to a storage tank of equal or lesser octane rating.

Another object of the present invention is to provide an improved, more efficient power assisted stage II vapor recovery system.

Yet another object of the present invention is to provide such a power assisted system which avoids the need for venting or burning recaptured vapor.

Still another object of the present invention is to provide a power assisted stage II vapor recovery system which is at least 99.5% effective.

Other objects will appear hereinafter.

SUMMARY OF THE INVENTION

It has now been discovered that the above and other objects of the present invention may be accomplished in the following manner. Specifically, an improved power assisted vapor recovery system for use with fuel dispensing nozzles has been discovered.

The system includes a fuel dispensing nozzle and a flexible vapor piping line operable connected to the nozzle for insertion into a tank for receiving fuel. The line has a small diameter with respect to the fuel dispensing hose supplying fuel to the nozzle. A secondary sump is connected to the other end of the flexible vapor piping line. The secondary sump has a source of vacuum for positively assisting flow of vapor through the line. A filter is disposed in the sump for separating fuel from the vapor to produce vapor clean air. A vent is provided for venting the vapor clean air from the secondary sump and drain means are provided for removing the separated fuel frown the sump.

In a preferred embodiment, the system includes a vacuum regulator means for regulating the vacuum in the line in order to maintain a vacuum of about 1 to about 5 inches of mercury in the line. Preferably, the diameter of the line ranges from about ½ to about 1 inch, and the vacuum is about three inches of mercury. All that is necessary is that the rate of flow of vapor be sufficient to carry any condensed fuel with it, so that all of the fuel is transferred to the filter means. Preferably, the vacuum regulator means will initially open upon activation of the nozzle to dispense fuel. The nozzle conventionally includes a trigger for controlling fuel flow, and is adapted to simultaneously control the flow of vapor in the vapor piping line.

The filter means which is disposed within the secondary sump preferably comprises a basket for supporting one or more filters therein. The basket is removably positioned in the secondary sump for cleaning and other purposes. In the preferred embodiment, the line introduces vapor into the secondary sump whereby vapor is removed from the air as air passes through the filter to the vent means at the top of the sump. The drain means is positioned at the bottom of the secondary sump. In a preferred embodiment, the drain means includes a means for connecting the drain to a fuel storage tank and a liquid trap for regulating flow of fuel out of the drain means without transmitting the vacuum to the storage tank. While various piping configurations are possible, it is preferred to return all of the collected fuel to the storage tank having the lowest octane rating in order to reduce piping costs and simplify the system.

BRIEF DESCRIPTION OF THE DRAWINGS

FIG. 1 is a schematic plan view of the system of this invention in combination with plurality of fuel dispensing units such as is found at a gas station and the like.

DETAILED DESCRIPTION OF THE PREFERRED EMBODIMENT

Figure 1:
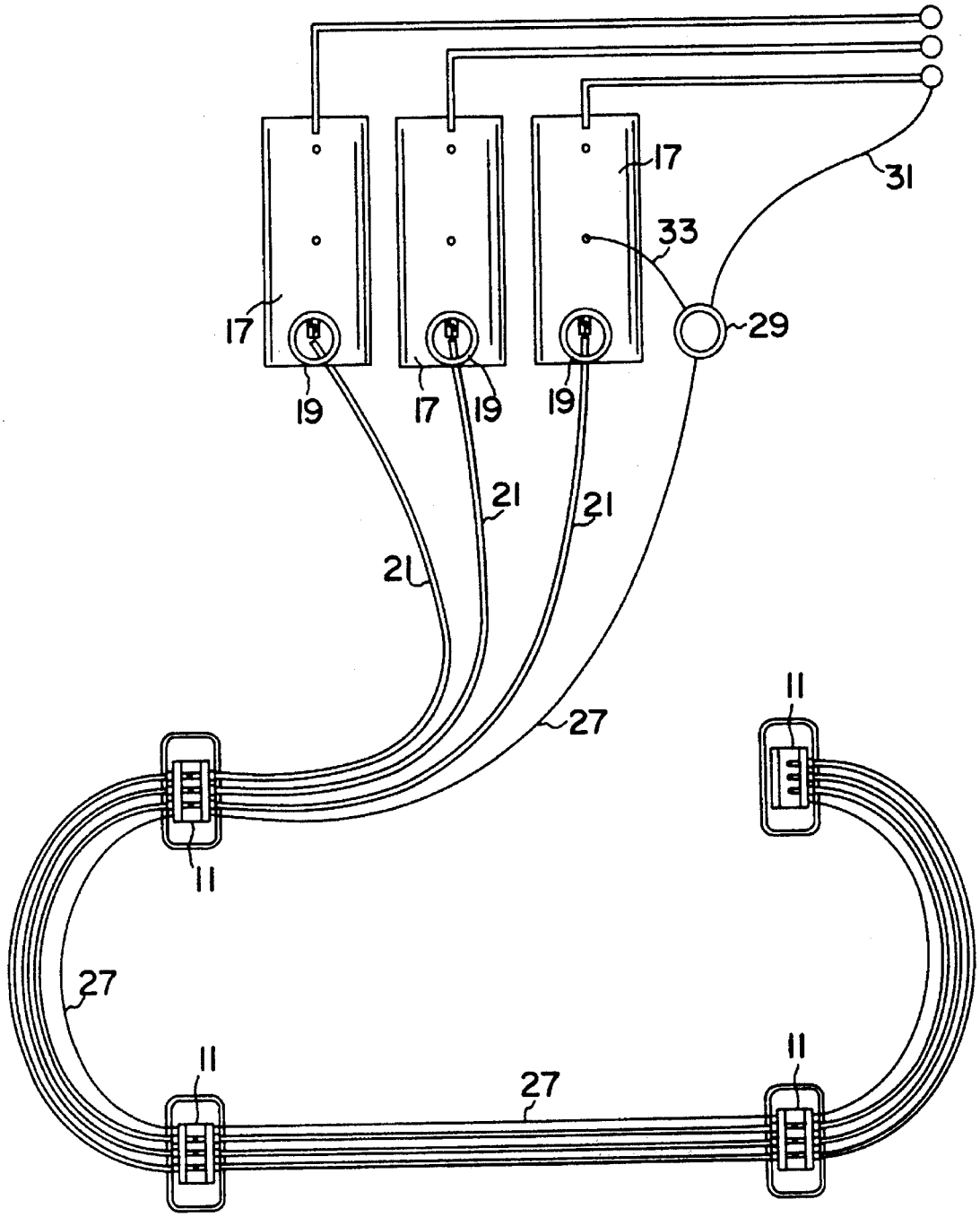

The system of the present invention shown generally in FIG. 1 by the reference numeral 10. The system incorporates a plurality of pumps 11 which are used to transfer fuels such as gasoline to a vehicle. Fuel is stored in storage tanks 17 and is pumped by pump contained in primary sump 19 through fuel line 21 to the pump 11. FIG. 1 illustrates a common system in which three grades of fuel are available for dispensing, with the grades of fuel shown highest to lowest from left to right.

Vapor is collected by the vapor recovery system of the present invention and exits pumps 11 via recovery lines 27 for transfer to secondary sump 29. In sump 29, fuel is separated from the air by filtration using a power driven vacuum pump that overdrives the vacuum in vapor return line 27. After complete separation is accomplished, air is transferred from secondary sump 29 via line 31 for venting. Collected liquid fuel is transferred by line 33 to the primary sump 19 and the storage tank 17. Note that all of the fuel recovered in sump 19 is returned to the tank with the lowest octane rating.

Figure 2:
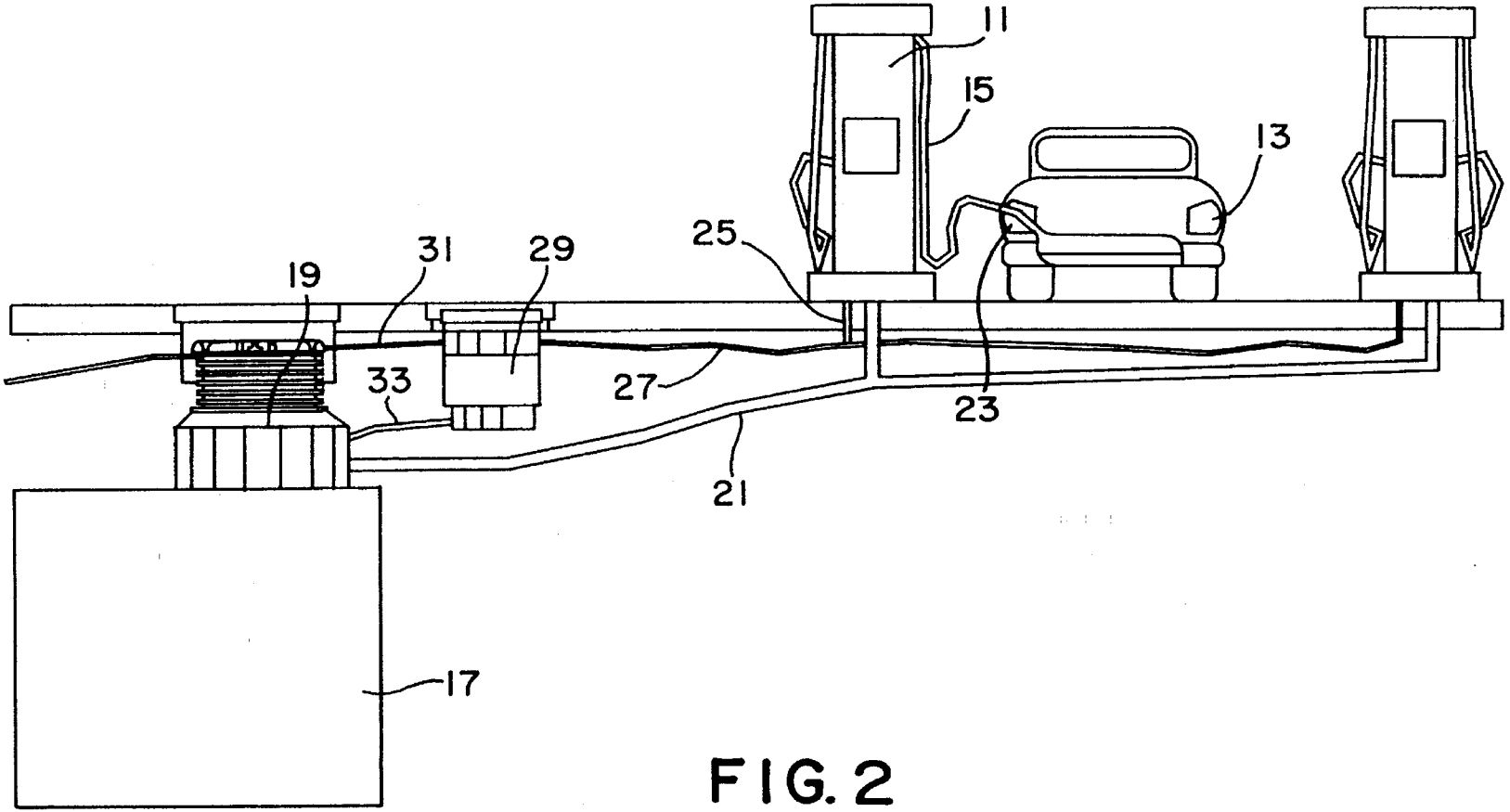
FIG. 2 is a schematic front view of the system of FIG. 1, illustrating the relationship of underground tanks and sumps to the dispensing pumps.

In FIG. 2, the operation of the system of this invention in dispensing fuel from pump 11 to vehicle 13 is shown. Fuel flows from tank 17 out of sump 19 through line 21 to pump 11, which then dispenses fuel through curb pump hose 15 through nozzle 23. Vapors are collected at nozzle 23 as fuel flows into vehicle 13, and those vapors are pulled by vacuum into individual vapor return line 25.

Line 25 and all of the other individual return lines for each separate pump are connected in series by simple "T" fittings. The vapor lines are small diameter flexible lines of a diameter ranging from about ½ inch to one inch, and can be made from nylon or other aromatic vapor-resistant materials. The vapor lines may also be made from rigid piping and junctions, if desired, but flexible pipe is preferred for ease of installation.

The velocity of flow of vapor in the small diameter line 27 is sufficient to prevent most, if not all, condensation, particularly since there is much less surface area than there would be on a larger line of say two inches as in the prior art balanced systems. Even when the system has been shut down, for over night perhaps, and a quantity of liquid fuel condense and accumulates at the low point in the vapor return line 27, the power of the vacuum will immediately transfer that fuel to the surrounding sump 19 for separation. Accumulations of three or four linear feet of fuel or more offer substantially no resistance to rapid transfer to sump 19. As can be seen in FIG. 2, the vapor line 27 is not level and no effort to provide gravity feed is needed. Thus retrofitting existing buried tanks can be accomplished by the present invention without regard for elevation of the tank 17.

Figure 3:
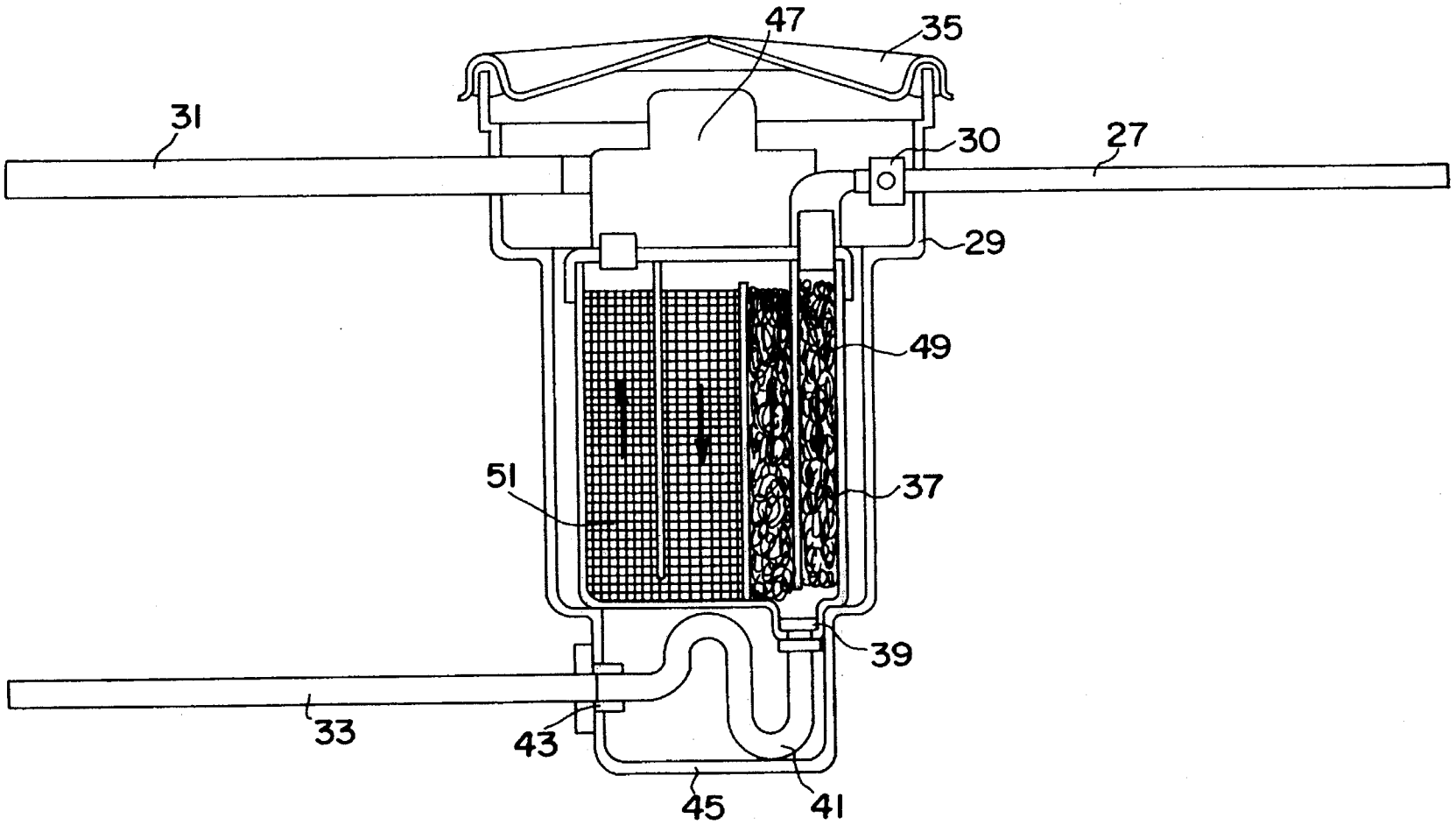
FIG. 3 is an enlarged schematic view of an underground sump forming part of the system of this invention.

The present invention provides substantial advantages in removing the fuel vapors from the air which is withdrawn as a fuel vapor from the vehicle tanks. As shown in FIG. 3, the vapor in line 27 enters sump 29 for recovery as the vacuum is controlled by vacuum regulator 30. Air is vented through air exhaust line 31 and liquid fuel is collected and returned to a tank by liquid fuel return line 33.

Sump 29 includes an access lid 35 and a removable basket 37 which is placed inside secondary sump 29. Fuel which is separated from the vapor drains down through bottom drain 39 of basket 37 and flows through trap 41 before exiting through exit boot 43 in lower sump collector 45.

As noted above, the present system is a power assisted vapor recovery system, and is driven by vacuum pump 47 which draws the vapor from the tank via line 27 through the filter 49, causing substantially all of the fuel to condense and drain through bottom outlet 39. The vacuum pump 47 also draws the air through air purifier 51 for exhaust out air exhaust line 31. Both filter 49 and air purifier 51 are filled into basket 37 as cartridges that can be removed easily for cleaning or replacement on a regular basis, such as annually.

Vacuum regulator 30 operates to control the vacuum in line 27, and maintain it at a preselected value of, for example, about 1 to about 5 inches of mercury. All that is needed is that the vacuum be maintained at a constant level, regardless of how many nozzles are being used at one time. Vacuum pump 47 is designed to operate at a constant output, and is most efficient if it operates continuously without changes in load. Vacuum regulator 30 is located as shown in FIG. 3 at the input side of filter 49 and air purifier 51. An alternative embodiment would locate the vacuum regulator 30 at the discharge side, such as in air exhaust line 31. A variety of vacuum regulators are currently available, such as those which employ a butterfly valve which is spring loaded to maintain a predetermined vacuum. The valve in regulator 30 will open larger as fewer nozzles are in use and will close down gradually as more nozzles are used simultaneously.

Other vacuum regulators such as electronically controlled vacuum regulators may be used as well, particularly if large numbers of nozzles are to be used at one time. Some service stations may have as many as 32 nozzles operating at one time. In any event, the vacuum regulator maintains a constant flow in cubic feet per minute of vapor through the vapor return line 27. This is accomplished, as was stated above, by maintaining the vacuum in a predetermined range. Typically, three inches of mercury of vacuum is adequate to accomplish the purposes of this invention and create an overpowered system to insure 100% recovery of the secondary vapors.

Figure 4:
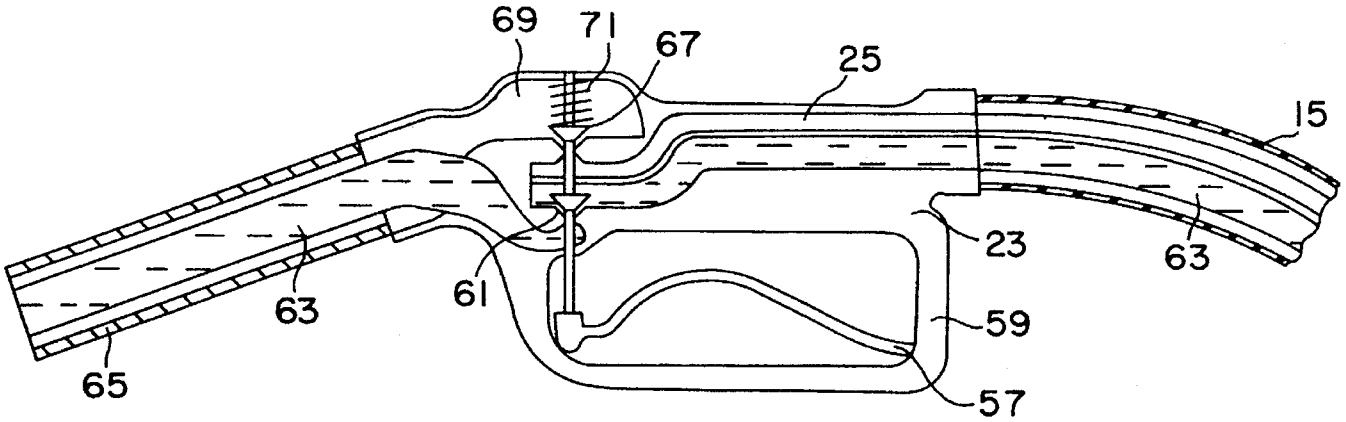
FIG. 4 is an enlarged, sectioned view of a dispensing nozzle forming another portion of the present invention.
Figure 5:
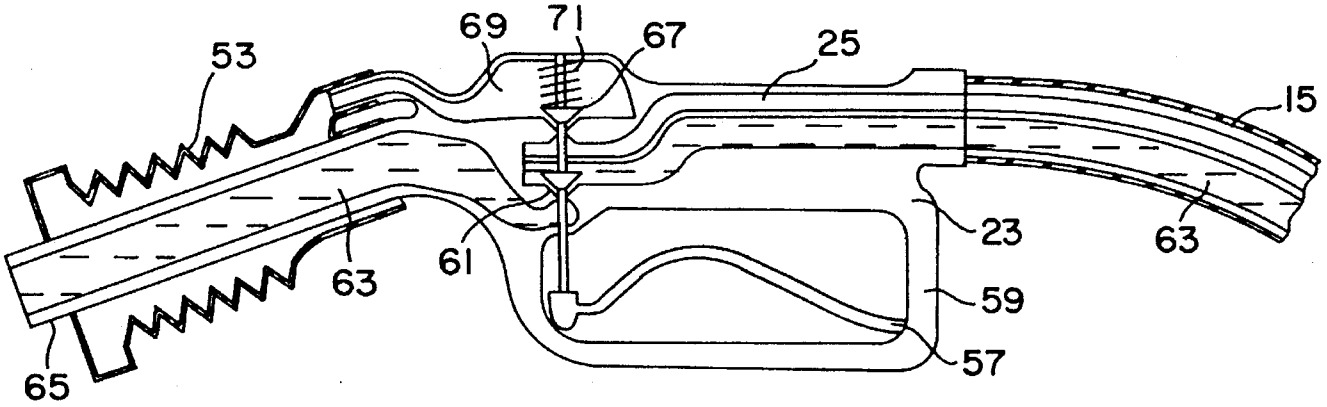
FIG. 5 is a sectioned view of another embodiment of the portion shown in FIG. 4.

A typical commercial nozzle is shown generally in FIG. 4 by the reference numeral 23. FIG. 5 shows an alternative version employing a boot 53. These nozzles are conventional, having a grip 55 and a trigger 57 supported in hand guard 59. Trigger 57 operates valve 61 which allows fuel 63 to flow through the nozzle 23 and be discharged into the tank of the vehicle out the discharge end 65.

Trigger 57 also opens valve 67 which allows the vacuum contained in individual vapor return line 25 to recover all of the vapor in the vehicle tank and the vapor which is formed by the discharge of the fuel 63 out the end 65 of nozzle 23. Vapor is collected in the vapor collection chamber 69 and passes valve 67 when depression of trigger 57 over comes biasing spring 71.

As can be seen, both the bootless version in FIG. 4 and the booted version in FIG. 5, commercially available nozzles can easily accommodate the system of this invention. Virtually 100% of the vapor is the tank along with additional surrounding air is pulled by the powerful vacuum force in lines 25 through lines 27 to sump 29 and separation of the fuel from the air.

This system is designed to be in full compliance with the presently existing federal and state regulations, including that of the state of California, and is anticipated to meet all proposed or projected regulations for the foreseeable future. All of the disadvantages of the previously used balanced systems are over come by the powered vacuum collection of fuel vapor by the system of this invention. Moreover, the previously described drawbacks of other prior powered systems, namely forcing vapor to be discharged into the atmosphere or, alternatively, combusted at the service station site, have been overcome. Pressure is not applied to the storage tanks themselves, nor is there any need to disturb those tanks.

Installation of the vapor return line is simple, and can be run in the same or a different ditch than the primary fuel lines. Connection of the individual vapor return lines from each pump in series permits the vacuum regulator to compensate for the number of lines in use at any one time, by maintaining the vacuum at a constant level in the primary vacuum return line. In this matter, the vacuum pump motor is not subjected to surges or forces which disrupt its smooth running.

Both dual line and coaxial piping, both flexible and rigid are all suitable for adaption to the system of this invention. Optimum efficiency and compliance with state and federal regulation is accomplished with a minimum cost to the service station and therefore to the end user. The present invention provides for a maximization of the protection that our environment deserves while permitting efficient and effective distribution of fuel.

We claim:

1. A vapor recovery system for use with liquid dispensing nozzles, comprising, a liquid dispensing nozzle;

a vapor line operably connected to said nozzle, said line having an orifice at a dispensing end of said nozzle, said line having a diameter smaller than a diameter of a dispensing hose for supplying liquid to said nozzle;

a sump connected to an other end of said vapor line, said sump having a source of vacuum for assisting flow of vapor through said line;

vacuum regulator means adjacent said sump open upon activation of said nozzle to dispense liquid;

filter means in said sump for separating liquid from said vapor to produce separated liquid and vapor clean air;

vent means in said sump for venting said vapor clean air from said sump, and drain means for removing said separated fuel from said sump, said vent means and drain means attached to said sump.

2. The system of claim 1 further comprising a vacuum regulator means for regulating the vacuum in said line to maintain a vacuum of about 1 to about 5 inches of mercury in said line.

3. The system of claim 2 wherein said vacuum regulator means is initially open upon activation of said nozzle to dispense fuel therefrom.

4. The system of claim 3 wherein said nozzle includes a trigger for controlling fuel flow and simultaneously for controlling entry of vapor in said vapor piping line.

5. The system of claim 1 wherein the diameter of said line is about ½ inch to about 1 inch.

6. The system of claim 1 wherein said vapor piping line is a flexible piping line.

7. The system of claim 6 wherein said vacuum pump produces vapor velocity sufficient to substantially eliminate condensed liquid build-up in said line.

8. The system of claim 1 wherein said filter means comprises a basket supporting a filter therein, said basket being removably positioned in said sump.

9. The system of claim 8 wherein said line introduces vapor into the sump, whereby vapor is removed as air passes through said filter, and said drain means being positioned at the bottom of said sump.

10. The system of claim 9 wherein said drain means includes connecting means for connecting said drain means to a fuel storage tank and trap means for preventing access of said vacuum to said storage tank.

11. The system of claim 10 wherein said drain means returns all fuel collected from a plurality of grades of fuel to a storage tank having the lowest octane rating.

12. A method of recovering vapor while dispensing fuel into vehicle tanks, comprising:

providing a vapor piping line at said nozzle;

subjecting said vapor line to a vacuum in excess of the pressure created in the tank by insertion of fuel regulating the vacuum upon activation of the nozzle to dispense liquid therein;

discharging vapor in said line into a sump, said sump having a source or vacuum for positively assisting flow of vapor through said line and filter means for separating liquid fuel from said vapor to produce liquid fuel and vapor clean air; and venting said vapor clean air and transferring said separated fuel to a storage tank.

13. The method of claim 12 further comprising regulating the vacuum in said line to maintain a vacuum of about 1 to about 5 inches of mercury in said line.

14. The system of claim 13 wherein said vacuum regulator means is initially open upon activation of said nozzle to dispense fuel therefrom.

15. The method of claim 14 wherein said nozzle includes a trigger for controlling fuel flow and simultaneously for controlling entry of vapor in said vapor piping line.

16. The method of claim 12 wherein the diameter of said line is about ½ inch to about 1 inch.

17. The method of claim 12 wherein said vapor piping line is a flexible piping line.

18. The method of claim 17 wherein said vacuum pump produces vapor velocity sufficient to substantially eliminate condensed liquid build-up in said line.

19. The method of claim 12 wherein said line introduces vapor into the sump, whereby vapor is removed as air passes through a filter, and a drain means are provided for connecting to a fuel storage tank and trap, preventing access of said vacuum to said storage rank.

20. The method of claim 12 wherein all fuel collected from a plurality of grades of fuel are returned to a storage tank having the lowest octane rating.

* * * * *

UNITED STATES PATENT AND TRADEMARK OFFICE

CERTIFICATE OF CORRECTION

PATENT NO. : 5,494,409

DATED : February 27, 1996

INVENTOR(S) : Michael C. Webb et al

It is certified that error appears in the above-indentified patent and that said Letters Patent is hereby corrected as shown below:

In column 2, line 44, the word "or" should be --for--.

In column 2, line 53, the phrase "which can collected" should read --which can be collected--.

In column 2, line 65, after the word nozzle please insert a ",".

In column 3, line 16, the word "lop" should be --top--.

In column 3, line 20, the word "requirements" should be --requires--.

In column 3, line 45, the word "fellows" should be --follows--.

In column 4, line 52, the word "frown" should be --from--.

In column 9, line 5, the word "rank" should be --tank--.

Signed and Sealed this

Eleventh Day of June, 1996

*Attest:*

*Attesting Officer*

Bruce Lehman

BRUCE LEHMAN

*Commissioner of Patents and Trademarks*